US005878874A

United States Patent [19]

Weggelaar

[11] Patent Number: 5,878,874

[45] Date of Patent: Mar. 9, 1999

[54] DEVICE FOR SECURING CARD-TYPE OBJECTS, IN PARTICULAR CHEQUE GUARANTEE CARDS AND CREDIT CARDS, AGAINST BEING LOST OR MISLAID

[75] Inventor: Franciscus G. A. Weggelaar, The Hague, Netherlands

[73] Assignee: Advuesbyreay F,G,A, Weggekaar B.V., Netherlands

[21] Appl. No.: 803,539

[22] Filed: Feb. 20, 1997

Related U.S. Application Data

[63] Continuation of PCT/NL96/00489 Dec. 19, 1996.

[30] Foreign Application Priority Data

Jan. 5, 1996 [NL] Netherlands ..... 1002032

[51] Int. Cl.[6] ..... A45C 11/18

[52] U.S. Cl. ..... 206/39.1; 206/39.5; 206/1.5; 150/147

[58] Field of Search ..... 206/39, 39.1, 39.2, 206/39.5, 1.5; 150/147, 149

[56] References Cited

U.S. PATENT DOCUMENTS

| | | | |
|---|---|---|---|
| 591,679 | 10/1897 | McNeill | 206/39.1 |
| 1,658,496 | 2/1928 | Qvarnstrom | 206/39.1 |
| 3,244,211 | 4/1966 | Byers et al. . | |
| 3,648,832 | 3/1972 | Kirshenbaum et al. . | |
| 3,688,896 | 9/1972 | Newell . | |
| 4,717,908 | 1/1988 | Phillips et al. | 340/568 |
| 4,805,820 | 2/1989 | Kearney et al. | 224/252 |
| 5,052,328 | 10/1991 | Eppenbach . | |
| 5,125,505 | 6/1992 | Kurosaki | 206/39.4 |

FOREIGN PATENT DOCUMENTS 2 669 813 5/1992 France .

*Primary Examiner*—Paul T. Sewell
*Assistant Examiner*—Nhan T. Lam
*Attorney, Agent, or Firm*—Deveau, Colton & Marquis

[57] ABSTRACT

A device for use in conjunction with a case or wallet that have compartments in which credit cards and the like are kept. The device has two parts which are movable relative to each other between a secure and open position. In the secure position, the cards and the device are retained for storage. In the open position, a card to be used may be removed from the device, but if the card is not replaced into the device, the device cannot return to the secure position. Therefore, should the user of the credit card not return the credit card to the device, it will be readily apparent to the user that the credit card is missing. The device has a locking lug which, depending on the locking lug's position in the device, the device may not be returned to the secure position unless the credit card used is returned to the device.

4 Claims, 17 Drawing Sheets

22
31
32
26
34
36
38
30
35
37
33
29'
29
23
24
28
27
28'
21
25

28
39
23
35
30
33
26

28
23
37
33
35
26

28
23
30
33
39
26
35

67

DEVICE FOR SECURING CARD-TYPE OBJECTS, IN PARTICULAR CHEQUE GUARANTEE CARDS AND CREDIT CARDS, AGAINST BEING LOST OR MISLAID

This is a continuation of International Application PCT/NL96/00489 filed on 19 Dec. 1996.

Device for securing card-type objects, in particular cheque guarantee cards and credit cards, against being lost or mislaid.

BACKGROUND OF THE INVENTION

The invention relates to a device for securing card-type objects, in particular cheque guarantee cards and credit cards, against being lost or mislaid, comprising:

- two parts which are movable relative to each other between a secure position in which the card is retained in its storage space and an open position in which the card can be removed,
- and mechanical means which prevent closure of the parts until in the secure position, and which can be rendered inoperable by means of the card.

Over the years a large number of proposals have been made for securing cheque guarantee cards and credit cards against being lost or mislaid. In this case the problem is not so much one of securing against theft, but rather of having an aid to ensure that when a card is used for the purpose for which it is intended the user does not forget to return it to the correct place in wallet or card case. Most proposals known hitherto have been based on electrical or electronic measures, often leading to some type of sound signal. These security circuits have become increasingly ingenious with the passage of time, but at the same time they have often become more susceptible to faults. Rising cost is almost always an inevitable consequence of this increasing degree of complexity.

Mechanical solutions were proposed, e.g. in U.S. Pat. No. 3,648,832, from which the device defined in the precharacterizing part of claim 1 is known. One of the disadvantages of this device is that it consists of a great number of parts. Apart from the fact that an embodiment for several cards gets the form of a box of a considerable thickness whilst users generally prefer a case or wallet form, this publication does not disclose an embodiment for a single card and the product is rather expensive.

A consequence of all this has therefore been that, despite the large number of proposals made, only a very small number have been put into practice.

THE OBJECTS OF THE INVENTION

The prime object of the invention is to find a solution to this problem and to provide a device for the above-mentioned purpose which is extremely simple, and can consequently be produced cheaply in large numbers, while, on the other hand, it functions reliably. Moreover the invention wants to realise this both for use with a case or wallet and for use in the form of a box designed to contain one single card.

SUMMARY OF THE INVENTION

Generally, the device according to the present invention is characterized by mechanical means formed of two parts, one part of which is an element movable with respect to the other part thereof and which is able to displace itself from a rest position to a blocking position, and a lug on the other part of said two parts against which said element runs.

The use of, firstly, the movable element and, secondly, the lug forms the key to the simple design.

Within this idea, the two above mentioned embodiments are possible.

The first embodiment has been developed for use with a case or wallet which is provided with compartments in which the cards are kept. The first embodiment comprises:

- two substantially flat parts which are hingedly connected to each other near an end edge of each preferably by a hinge pin,
- the first part near the hinge pin being provided with a chamber which is open near the end edge of the part, and in which said displacing element is situated, in form of a locking lever which can swivel about a swivel pin crossing the hinge pin at right angles,
- in that the second part is provided with a first moulded-on finger which comes to rest against the locking lever at one side of the swivel axis thereof, in such a way that when the two parts are swung open the locking lever will swivel, and the other end of it goes into the movement path of a second finger moulded onto the second part in the chamber, and, as a result, a closing movement of the second part is blocked, and
- in that the hinge pin lies at least a card thickness higher up than the internal face of the second part, thereby producing a slit-shaped space, so that—in swinging the device through the open position thereof—by inserting a card through the interspace into the chamber, the locking lever can be swivelled back in order to release the blocking of the second part.

In the light of the objective set, the construction is simple, but the way in which it works is also simple. The first part is inserted into an existing case or wallet, into the top compartment. The second part covers all cards, is swung open when a card is needed, and cannot be closed again unless the card is used to release the blocking.

The second embodiment forms part of a holder for keeping a single card, formed by the fact that the two parts which are movable relative to each other together bound a space in which the card can be accommodated.

In that case the remaining procedure is preferably such:

- that one part comprises a bottom face with raised edges on two opposite sides and at least one stop edge for the card at one of the other sides,
- that the bottom face is provided with at least one resilient element which can be pressed into the bottom face by a card which is present, and will spring up from said face in the absence of a card,
- the second part being provided with a stop lug for the resilient element, at such a point that, after a relative movement of the two parts to the open position in which the card can be removed, the two parts are prevented from moving back to the closed, secure position.

This embodiment of the invention can be realized in the form of a sliding box or a swivelling box.

There is another advantageous embodiment which goes back to the idea of having the mechanical means formed by an element moving from a rest position to a blocking position and a lug on one of the two parts running against said element. This embodiment can be realized in the form of a folding box, and it is then characterized in that it comprises

- a box part, dimensioned in such a way that a card and a spring can be present in the internal space thereof, and of which box part a section of one of the large faces is fixed, while a section is open and a front side contiguous therewith is also open, a lid part, substantially dimensioned in such a way that it can close said open section of the box part, it being hingedly fitted substantially at the position of the end edge of the fixed top part, the lid part at the front side being provided over a part of the width with at least one gripping edge for the card edge, in that in the closed end of the box part there is a spring which is placed under tension by a card pressed against it, and in that the bottom face of the box part at the open front side and/or the lid part near the gripping edge for the card is/are provided with a recess over a depth which at least corresponds to the compression depth of the spring when the card is placed in the holder.

The invention will be explained in greater detail below with reference to the appended drawings, in which four embodiments are shown.

DESCRIPTION OF THE FIGURES

FIGS. 1 to 5 relate to the first embodiment;

FIG. 1A the closed position, FIG. 1B the open position, FIG. 1C the blocked situation, and FIG. 1D the unlocking;

FIG. 2 shows the device in top view in the closed position;

FIG. 3 shows separately the first part in top view, FIGS. 3A and 3B showing sections in the direction of the arrows A—A and B—B respectively, and FIG. 3C being an end view;

FIG. 5 shows the second part in top view, FIGS. 5A, 5B and 5C being respectively a section in the direction of the arrows A—A and views in the direction of the arrows B and C;

FIG. 6 shows in the fitted and closed position of the parts a top view of the first part, omitting the second part, i.e. a top view, partially section, in the direction of the arrows VI—VI in FIG. 6B, while

FIGS. 7 to 10 show a second embodiment in the form of a sliding box, intended for the accommodation of a single card.

FIG. 7 is an isometric drawing, partially cut away, of a sliding box in a partially opened state, from which the card can be removed;

FIGS. 8A to 8C show longitudinal sections through the box at the position of a resilient lip, in the closed position and in the partially opened position according to FIG. 7 respectively, and finally in the position opened to the maximum;

FIG. 9 shows a top view of the sliding part;

FIG. 10 shows a bottom view of the sleeve part, FIG. 10A a section in the direct ion of the arrows A—A in FIG. 10, FIG. 10B a side view toward the long side, and FIGS. 10C and 10D end views towards the short sides.

FIG. 11 is an isometric drawing, showing the principle of the blocking, in which half of the lid part has been omitted;

FIG. 12 shows the corresponding top view in the same position of the parts, but with the full lid shown;

FIG. 13 shows the box part in top view; and

FIG. 14 shows a bottom view of the lid part; and

FIG. 15 shows the two parts assembled to form a closed box,

FIG. 15A being a longitudinal section along the centre line according to the arrows A—A in FIG. 15, and FIG. 15B being a cross-section according to the arrows B—B, while

FIGS. 16 to 20 show a fourth embodiment;

FIG. 16 shows the box diagrammatically in perspective view with disassembled parts;

FIGS. 17 to 17D relate to the bottom part,

FIGS. 18 to 18E relate to the fixed top part;

FIGS. 19 to 19E relate to the movable top part or lid, and

FIGS. 20 to 20B show the box (card holder) in the closed position.

DESCRIPTION OF THE PREFERRED EMBODIMENTS

Figure 1A:
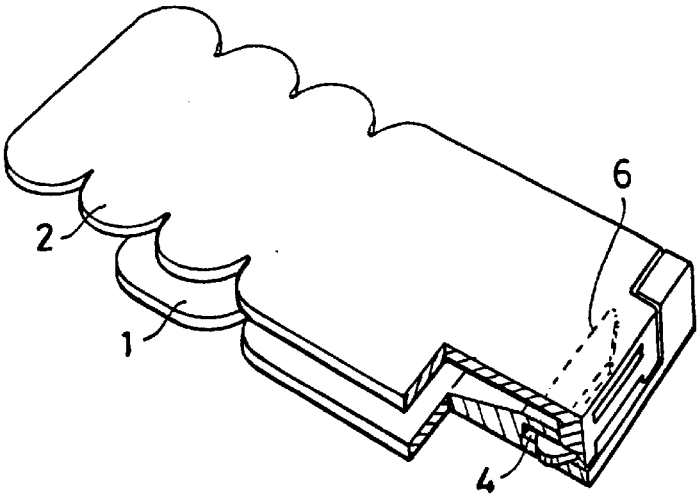
FIGS. 1A to 1D show diagrammatically, partially cut away, in perspective in succession.

FIG. 1A shows the device in the closed, secured position. It consists of a first part or bottom part 1, which is relatively short in relation to the second part yet to be described, and which is designed to be inserted into a case or wallet of the known type, provided with compartments in which cheque guarantee card and credit cards are kept; said insertion is into the top compartment. The rear side of part 1 can be provided with a simple layer of adhesive, by means of which the device can be fastened to a sufficient extent after removal of a piece of film.

The second or top part 2 is longer than the first part and is designed to lie on top of all card compartments.

The parts 1 and 2 hingedly connected to each other by a connecting means. In a preferred embodiment, the connecting means hingedly connects parts 1 and 2 to each other near their top edges about a pin 3 (see FIG. 1D), so that the device can be opened from the closed position of FIG. 1A, as shown in FIG. 1B, indicated by arrow P1.

The bottom part 1 is provided with a chamber 4 which is open towards the end edge. It contains a locking lug 6 which can swivel about a swivel pin 5 (see FIG. 1C) crossing the hinge pin 3 at right angles. The chamber 4, locking lug 6 and swivel pin 5 are one embodiment of a swivel means to swivel part 2 in a perpendicular plane to part 1. (see FIG. 1B).

Figure 1B:
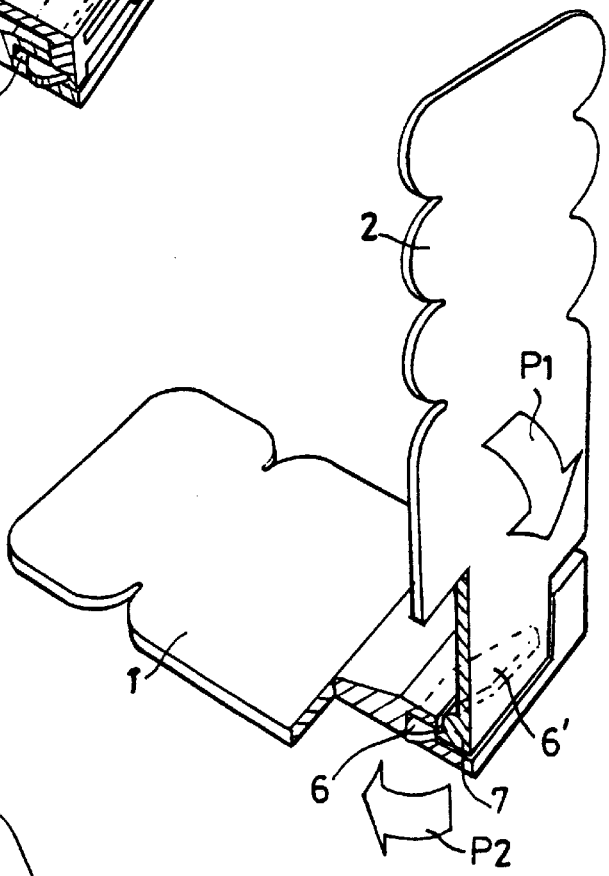
Figure 2:
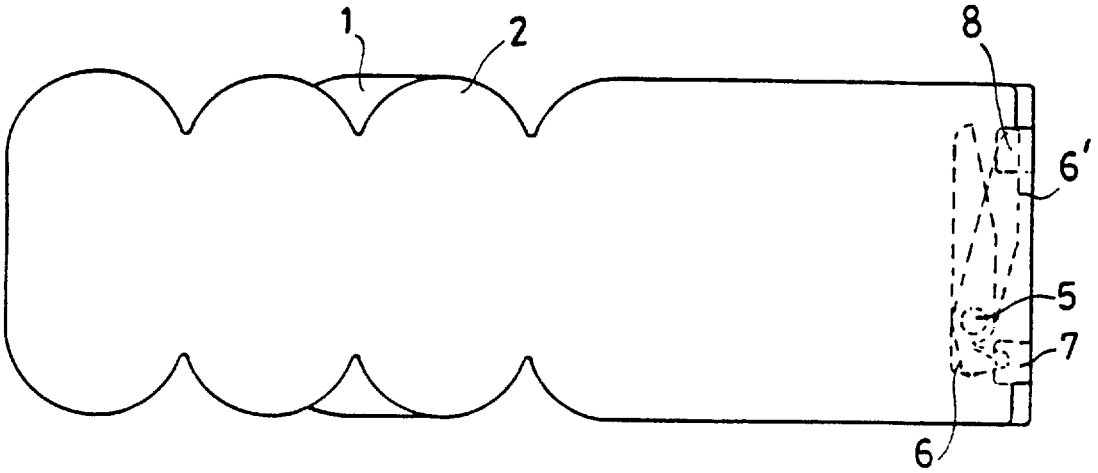
Figure 4B:
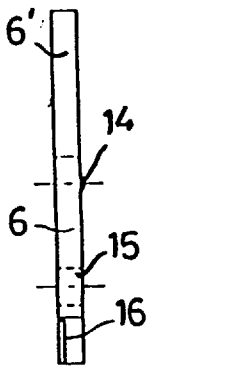
FIGS. 4A and 4B show a top view and a front view respectively of the locking lug.
Figure 4A:
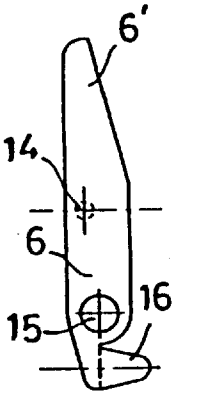

Near the hinge pin 3, the second part 2 is provided with a moulded-on finger 7 which, during opening of the top part 2 comes to rest again the locking lug 6, with the result that on further opening the latter will swivel about the pin 5 in the chamber 4; this swivelling movement is indicated by the arrow P2 in FIG. 1B. The various positions of the lug 6 can be seen from a comparison of FIGS. 1A and 1B, but in particular from FIG. 2.

Figure 1C:
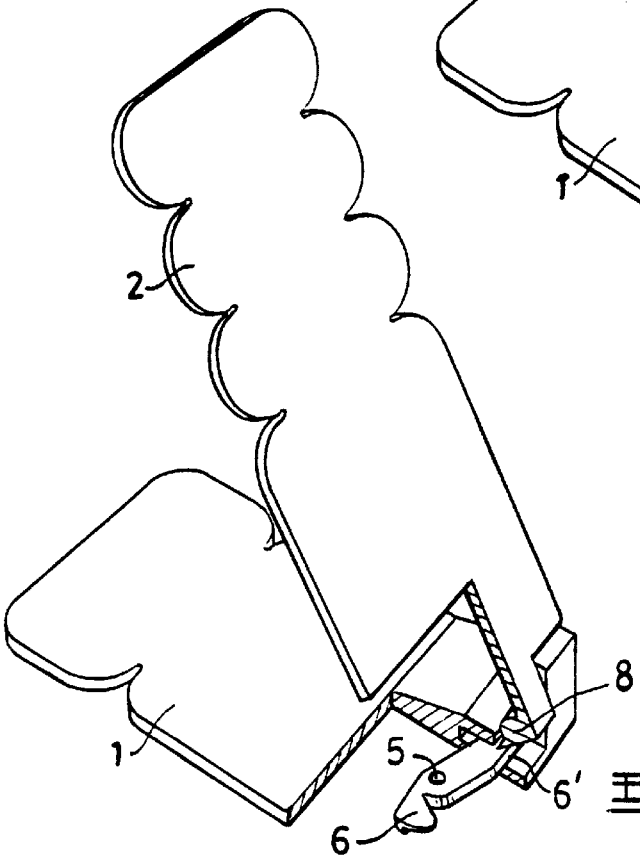

A second finger 8, which can be seen in FIG. 1C, is moulded onto the second par 2, which second finger has to move through the chamber 4 ring the reclosing (of course, also during the opening), but which is prevented during the closing movement by the fact that the part 6' of lug 6 at the other side of swivel pin 5 has gone into the movement path of finger 8. A closing movement of part 2 relative to part 1 is consequently blocked, as shown in FIG. 1C.

Figure 1D:
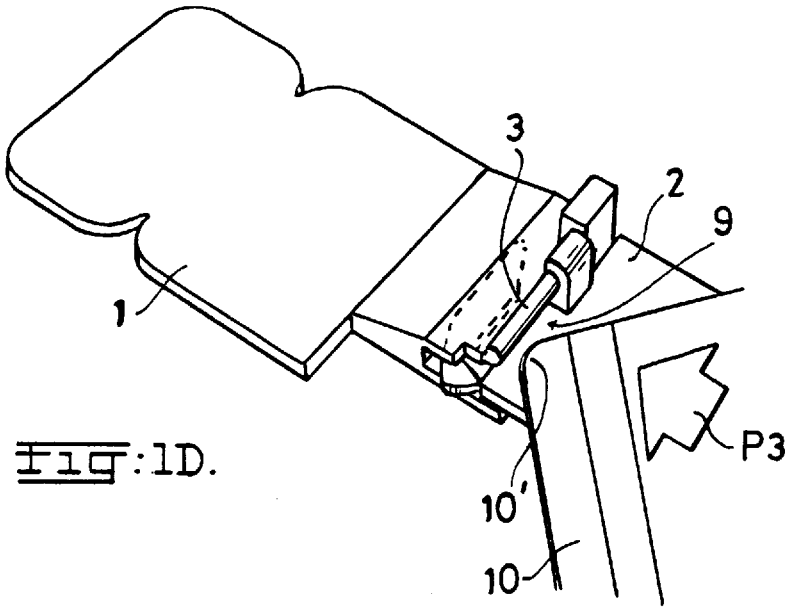

This blocking can be released as follows. In the fully or virtually fully opened position of part 2 relative to part 1 (FIG. 1D) a slit-shaped space is present above part 2 and below the hinge pin 3, as part of the open side of the chamber 4. This slit-shaped space 9 is at least as high as the thickness of a card 10. With the point 10' of a card, the locking lug can be reached through the slit 9, approximately at the transition from part 6 to part 6', so that said locking lug can be swivelled back to the initial position, and the blocking described in FIG. 1C can be released. This unlocking movement of the card is indicated by arrow P3 in FIG. 1D. FIG. 1D is shown in the position in which the lug 6 has just been pressed back by the point 10' of the card. Following this, the parts 1 and 2 can therefore be closed again.

The security principle is that the device can be closed only by means of the card which has been given out. So long as it has not been returned, the device remains open, and it cannot be closed any further than to the position shown in FIG. 1C. This means that the wallet cannot be closed and put away either. After the blocking has been released (FIG. 1D), the user can replace the card in the compartment designed for it, and the device can be closed and the wallet put away. The blocking mechanism has then returned automatically to the initial position, ready for reuse.

Further details emerge from FIGS. 3 to 6.

Figure 3C:
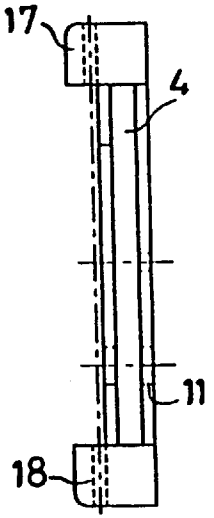
Figure 3:
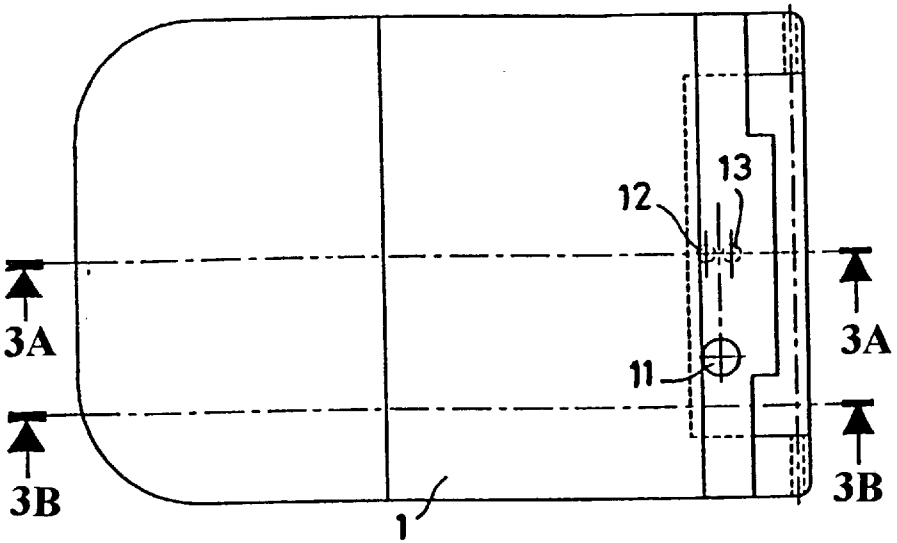
Figure 3B:
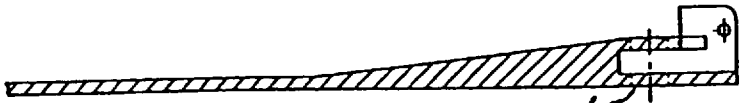
Figure 3A:
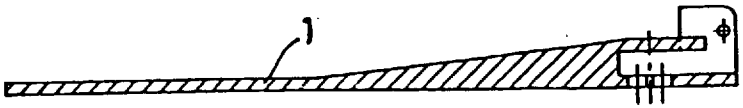

It can be seen in FIGS. 3A and 3B that the bottom part 1 is not completely flat, i.e. of uniform thickness, but has a slightly increasing thickness in the direction of the hinge pin, for the purpose of accommodating therein the open-ended chamber 4 for the locking lug. At right angles to the main face, this part is provided with a through bore 11 (see FIGS. 3 and 3C), designed for the accommodation of a swivel pin for the locking lug, which swivel pin is manufactured as a separate part. For the rest, two small bores 12, 13 are provided in the lower wall of the chamber 4 alone. These serve to form rest points for the locking lug 6 (see FIGS. 4A, 4B), by the fact that a thickening 14 formed on the locking lug 6 in the rest position can snap into bore 12, and in the blocking position can snap into bore 13, in order to prevent closure.

Locking lug 6 also has a through bore 15 for inserting the swivel pin (not shown). It can also be seen in FIGS. 4A and 4B that the place where finger 7 of the second part presses against locking lug 6 is formed by a lip 16. The latter has not the same thickness as the remainder of the locking lug 6, but has been made so much thinner that it can spring easily. This is necessary because during the closing of the device, although the blocking of the second finger 8 has been released, the first finger 7 also has to swivel back to its initial position, ready for reuse; in the case of the last-mentioned movement it then bends the lip 16 which, as a result of the release of the blocking of the second finger 8, has assumed a position in which it would block the return movement of finger 7 if it were not designed to be resilient in the manner shown, in order to be able to allow finger 7 to pass.

Figures 5, 5A, 5B, 5C:
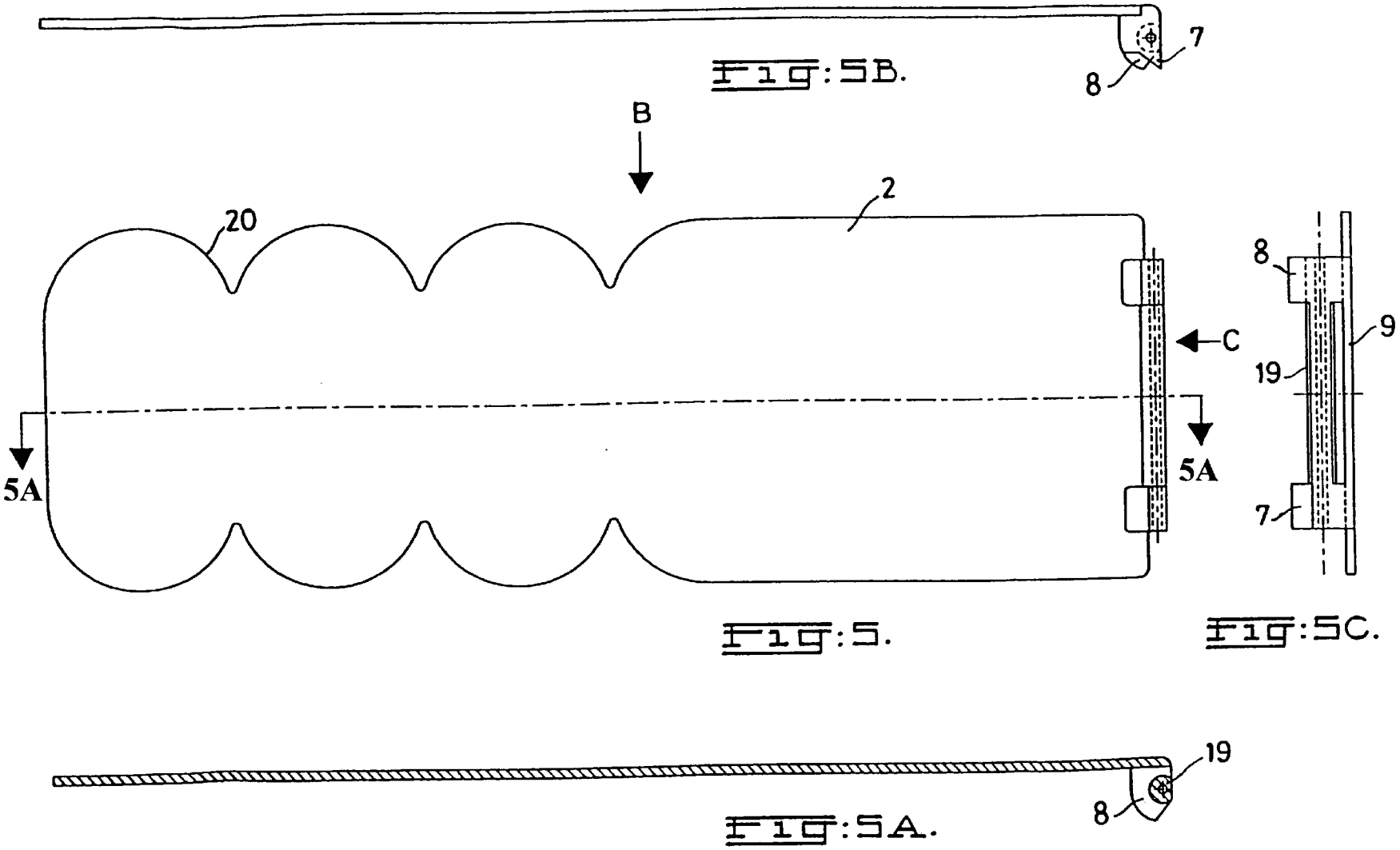

The correct position of the lugs 7 and 8, which are moulded onto part 2, can be seen in FIGS. 5 and 5C. They come to rest within block-shaped uprights 17 and 18 on part 1. Between these lies a quantity of material 19, through which the hinge pin runs. FIGS. 5A and 5B show the correct shape of the lugs 7 and 8, viewed in the direction of the hinge pin 3; lug 7 works during the opening and causes the locking lug to swivel, and finger 8 is impeded in its movement path by the other end 6' of the locking lug 6 when an attempt is made at closure.

It can also be seen in FIG. 5 that the top part 2 is provided with a number of indentations such as 20, by means of which it is easy to break off parts of the length of part 2, in order to adapt the size thereof to the specific size of the wallet in which it is to be used.

Figure 6:
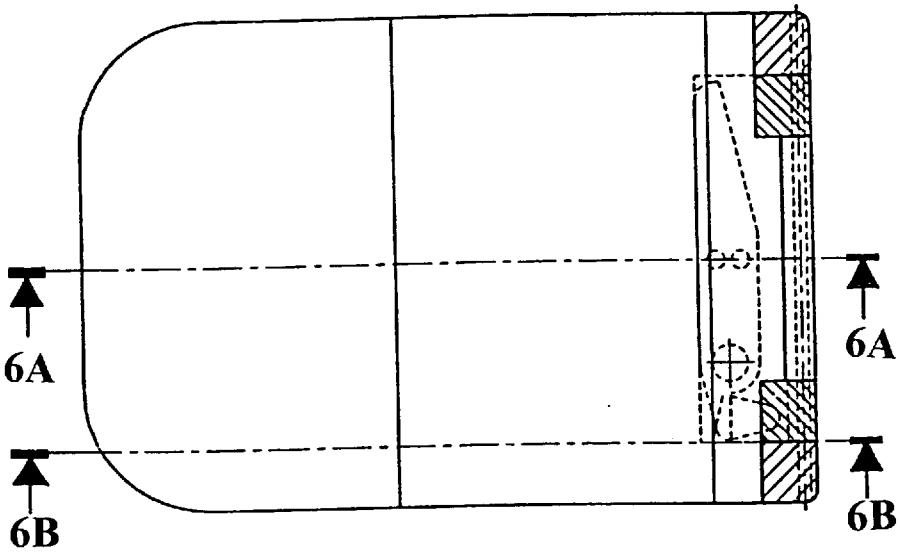
Figure 6B:
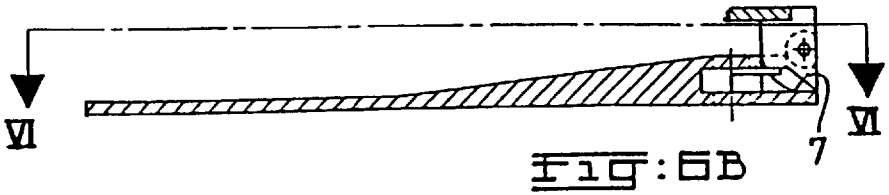
FIGS. 6A and 6B are sections in the direction of arrows A—A and B—B respectively in FIG. 6.
Figure 6A:
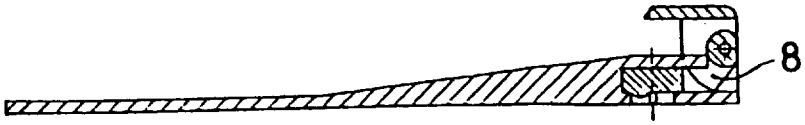

Finally, FIGS. 6, 6A and 6B show the combination of the parts, illustrated in the closed position of the device. It will be clear from these figures that lug 7 comes to rest against lip 16 of the locking lug only to make the locking lug swivel through approximately 90° relative to part 1 after an opening movement of part 2. That movement is too small for the removal of a card; a card can be removed only when part 2 is opened virtually through 180°, and then the locking mechanism has gone into action in the second half of that movement.

In the case of the embodiment of FIGS. 7 to 10 the first part 21 is a sliding part, and the second part 22 is a sleeve part.

The sliding part is formed by a bottom face 23 with raised edges 24, 25 at two opposite long sides and a stop edge 26 at the one short side situated inside the sleeve part. At the fourth, short side two raised stop edges 28, 28' are provided on either side of a semi-circular recess 27 in the bottom face. Said stop edges bound a space in which the card can be placed, and the stop edges 28, 28' are so much higher than the other stop edges that when the part is slid in they run against the short side 29 of the box part, so that they determine the closed position of the sliding box.

Figures 7, 8A, 8B, 8C:
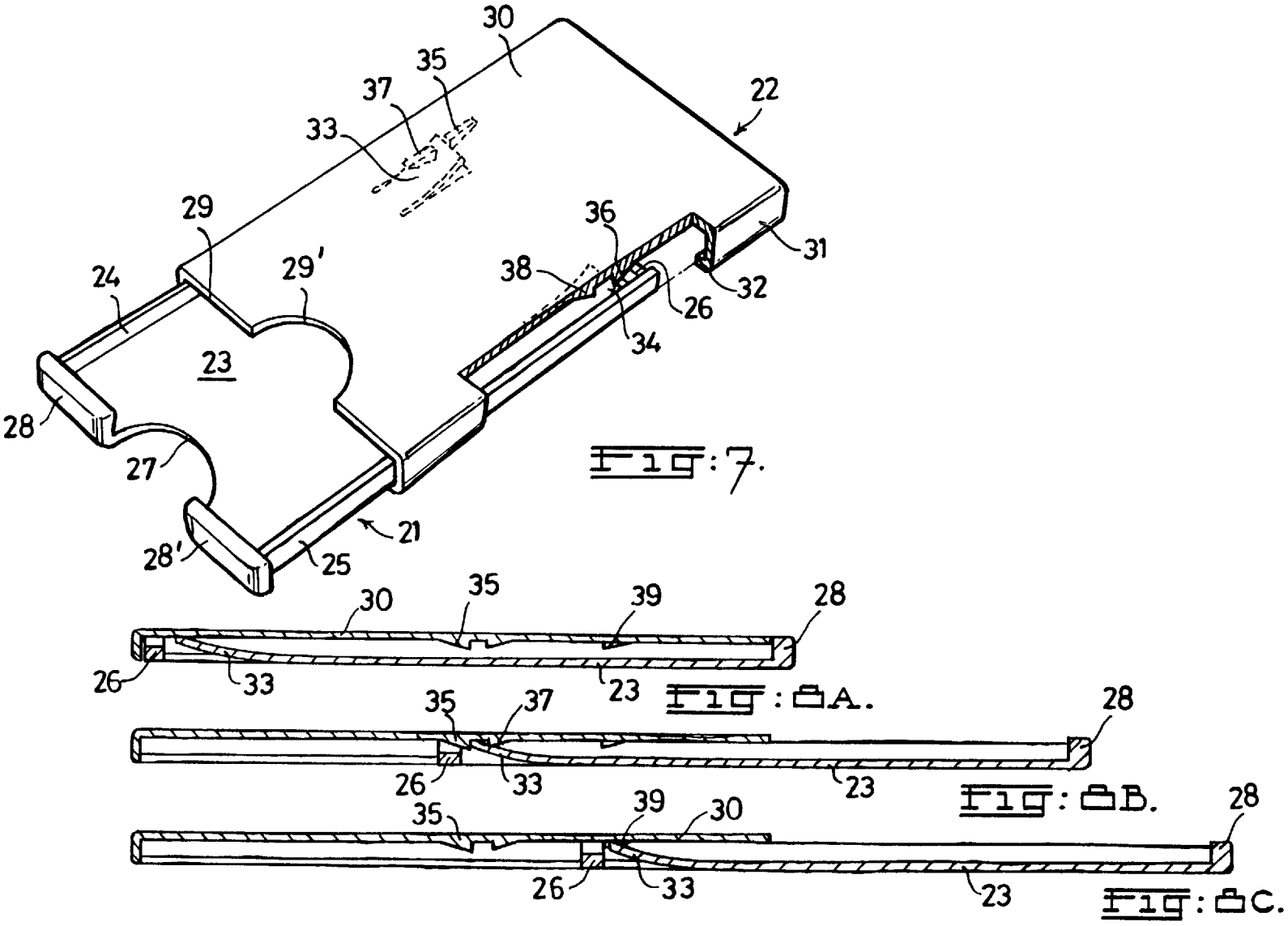

The sleeve part 22 is formed by a top face 30 which at the two opposite long sides is provided with edges such as 31 which grip over the raised edges 24, 25 on the sliding part 21 and around the edges of the bottom face 23 thereof, as is made visible in FIG. 7 at 32 by cutting away the sleeve part, for the sake of the drawing.

The bottom face 23 of the sliding part contains two resilient lips 33 and 34. The side facing the sliding part (inside) of the sleeve part is provided with two stop lugs 35 and 36 at corresponding points. In the extended position, shown in FIG. 7, the resilient lips 33, 34 run against the stop lugs 35 and 36, so that further sliding in is not possible. This is shown in greater detail in FIG. 8*b*, which shows the two parts of the sliding box in the same position as in FIG. 7. The blocked position can be released only by pressing the resilient lips 33, 34 back down, substantially until they are flush with the bottom part 23, by sliding a card back into the sliding part 21. In order to ensure that the resilient lips are pressed sufficiently far down, pressure lugs 37 are placed at a short distance before the stop lugs 35, 36. Said pressure lugs guide the inserted card, in order in the first place to ensure that the card itself does not run against the stop lugs 35, 36 and prevent the sliding part from sliding in, but also, as already stated, to press the resilient lips 33, 34 sufficiently far down to ensure that they can pass the stop lugs 35, 36 again.

The security principle in this embodiment is therefore that the box cannot be closed without the card being situated therein. The opened box, with effective blocking between sliding part 21 and sleeve part 22 is considerably longer than it is in the closed position. Generally speaking, the user will not put away the box in that special position without noticing it, but will do so only after reinserting the card therein so that the box can be closed again.

This box also fits into a wallet compartment.

FIG. 8C also shows that at least one further blocking lug 39 is fitted yet further forward on the underside of the top face 30 of the sleeve part. The stop edge 26 at the end edge of the sliding part runs against said lug, with the result that the sleeve part can no longer leave the sliding part. During assembly this lug 39 does not form any obstacle, because the stop edge 26 will then slide along the sloping side of lug 39, deforming the sleeve part in the process; stop edge 26 runs against the straight edge of blocking lug 39 only on the return movement.

Figure 9D:
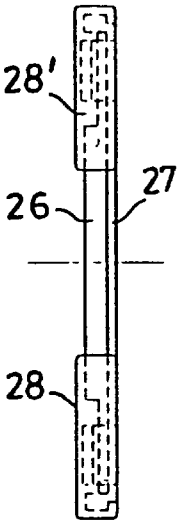
Figure 9:
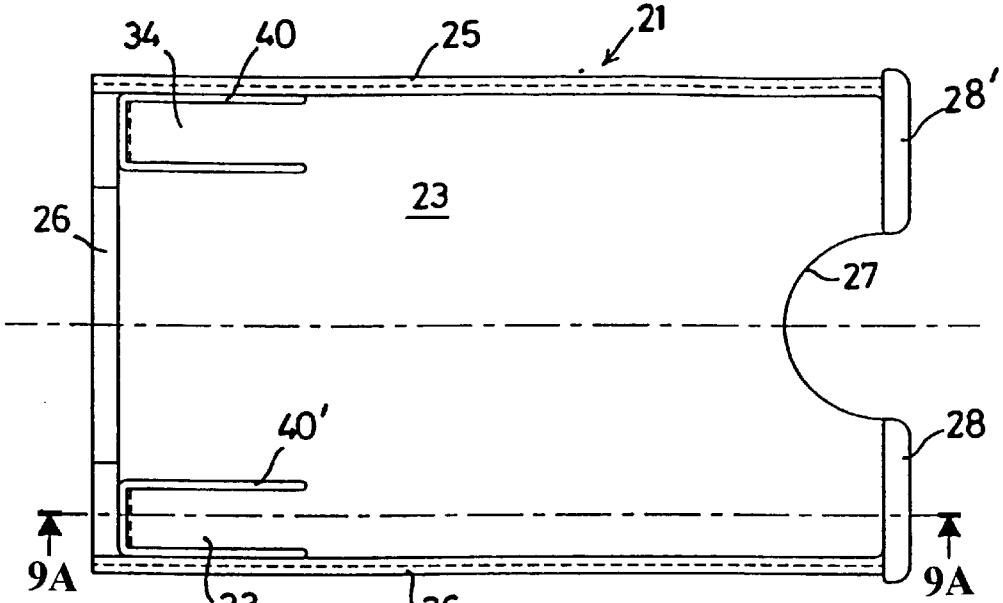
Figure 9B:
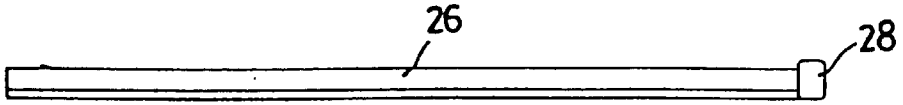
Figure 9A:
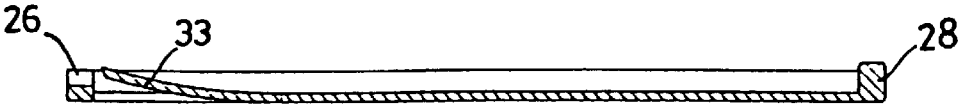
FIG. 9A shows a cross-section in the direction of the arrows A—A in FIG. 9, FIG. 9B a side view towards the long side, and FIGS. 9C and 9D and views towards the short sides.
Figure 9C:
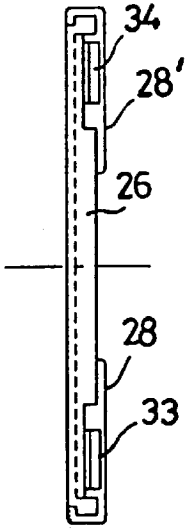
Figure 10D:
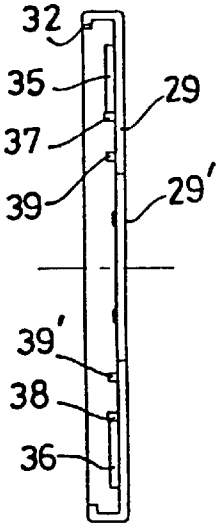
Figure 10:
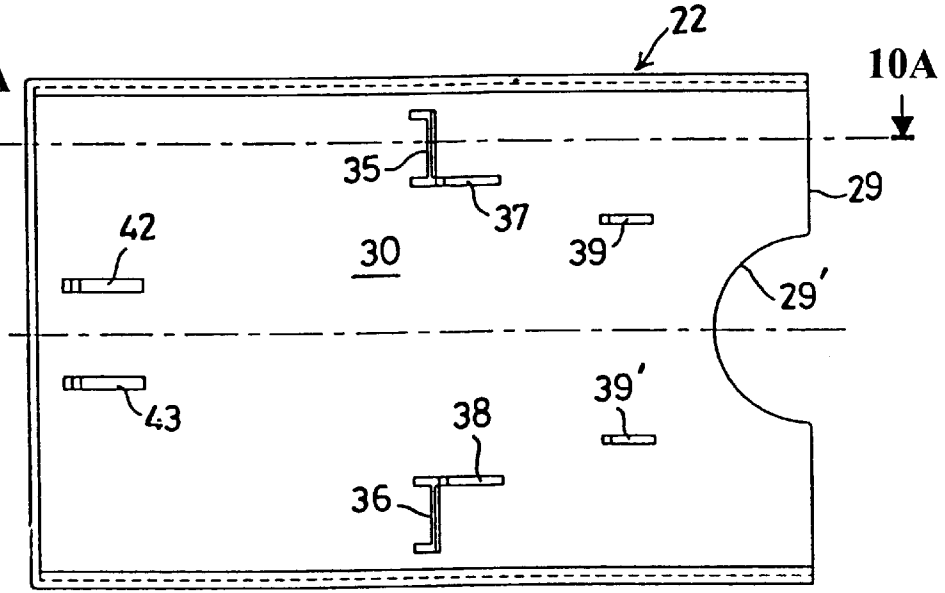
Figure 10B:
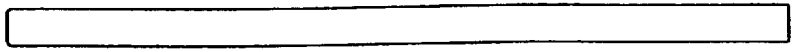

Further details can be seen from FIGS. 9 and 10. In FIG. 9 it can be seen that the resilient lips 33, 34 in the bottom face 23 have been made by making U-shaped recesses such as 40. The curved shape of the resilient lips can, of course, be obtained directly by injection moulding plastic, while the U-shaped recesses then give space for unimpeded bending substantially down to the bottom face 23 under the influence of an inserted card.

FIG. 10, which is a bottom view towards the sleeve part 22, shows the places where the various lugs are fitted. The stop lugs 35, 36 are preferably in the form of raised edges of such length in the crosswise direction that a considerable part of the width of the resilient lips 34, 34 runs against them. Of course, in the light of their function as card guides, the pressure lugs 37, 38 extend in the lengthwise direction. The blocking lugs 39, 39' can also extend in the lengthwise direction, for short sides are sufficient to retain the stop edge 26 of the sliding part. Finally, we see the parts 42, 43 which have not yet been discussed. These are two further snap lugs of low height, which are effective in the fully slid-in position, for retaining the stop edge 26 of the sliding part and preventing the sliding part 21 from accidentally sliding out of the sleeve part.

Figure 10A:
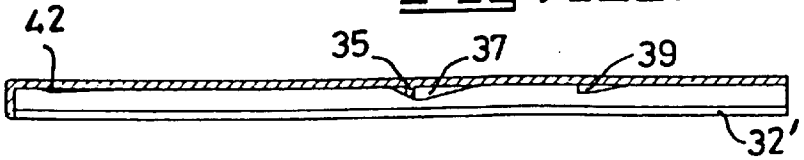
Figure 10C:
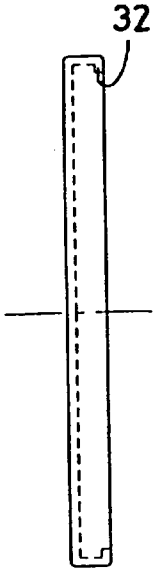

Finally, FIGS. 10A, 10C and 10D show the gripping edges 32, 32' on the long sides of the sleeve part, which are designed to grip around the edge of the bottom face 23 of the sliding part 21.

In the third embodiment according to FIGS. 11 to 15, the first part or bottom part 41 is again provided with a bottom face 43 with raised edges 44 and 45 on the long sides and raised edges 46 on their short side. A space for the insertion of a card is again formed in this way. A swivel pin 47, by means of which the second part or lid part 42 can swivel relative to the bottom part, is present in the centre of that short side.

The bottom part is again provided with a resilient lip 48, in this case a single resilient lip in the centre, but again formed in the same way as in the previous embodiment, with a U-shaped recess 49 in the bottom face 43.

The lid part 42 is provided on the underside with a horseshoe-shaped stop lug 50. When a card is situated in the box, the resilient lip 48 is pressed down, and the stop lug 50 slides over the card surface when the lid is swivelled in order to open the box. After removal of the card, the spring 48 springs upwards into the position shown in FIG. 11. The stop lug 50 consequently prevents the lid from swivelling back. The box cannot be closed again until after the spring 48 has been pressed down by the card being returned to its place. The security principle is therefore again that the box cannot be closed without the card being inside it. In the open position the box is considerably larger and more noticeable than in the closed position, and a person will therefore not put it away in that position. The compact position for putting it away is that in which one is certain that the card has been replaced therein.

Figure 13:
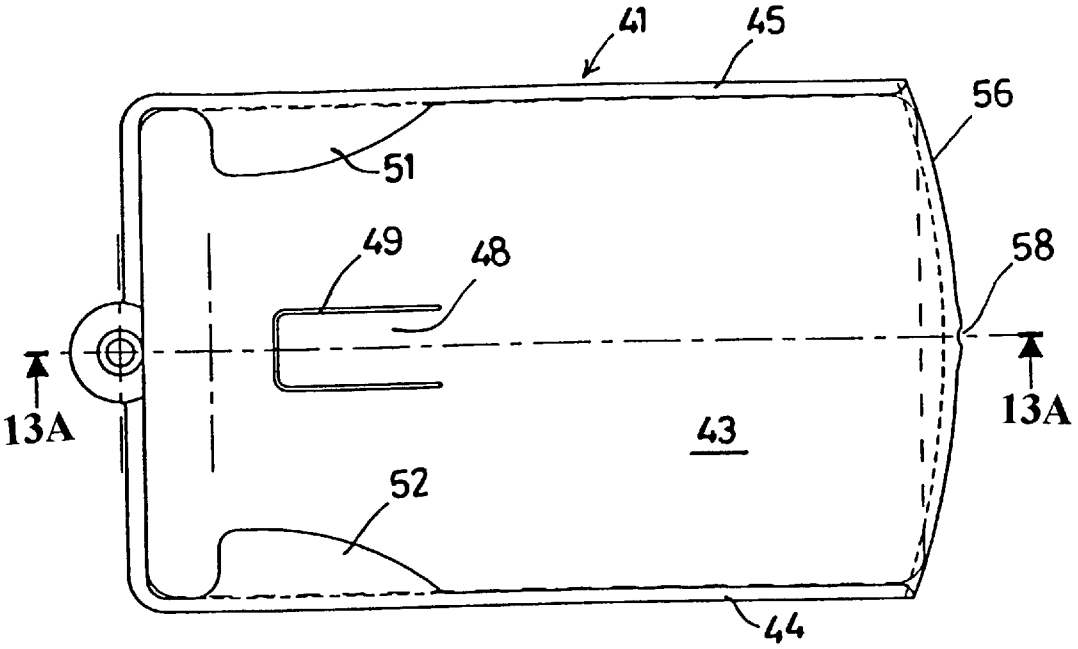
Figure 13A:
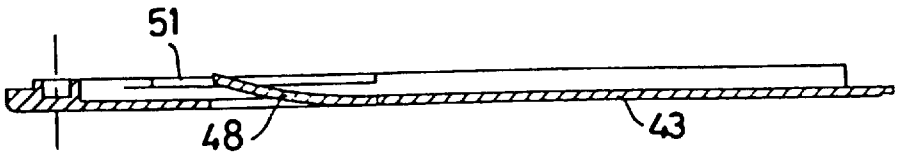
FIG. 13A is a longitudinal section here according to the arrows A—A in FIG. 13.

FIG. 13 shows only the box part. The upward-bent position of resilient lip 48 can be seen in FIG. 13A. It can also be seen from this figure that a card guide 51, two of which are present, indicated by 51 and 52 in FIG. 13, is moulded onto the raised edges 45, 44 respectively, but so high up that a card to be inserted can slide underneath it. This ensures that the resilient lip 48 will be pressed sufficiently far into the bottom face 43, while the stop lug 50 has a height which will correspond to the height of the card guides, with the result that it can move unimpeded over the card surface.

Figure 12:
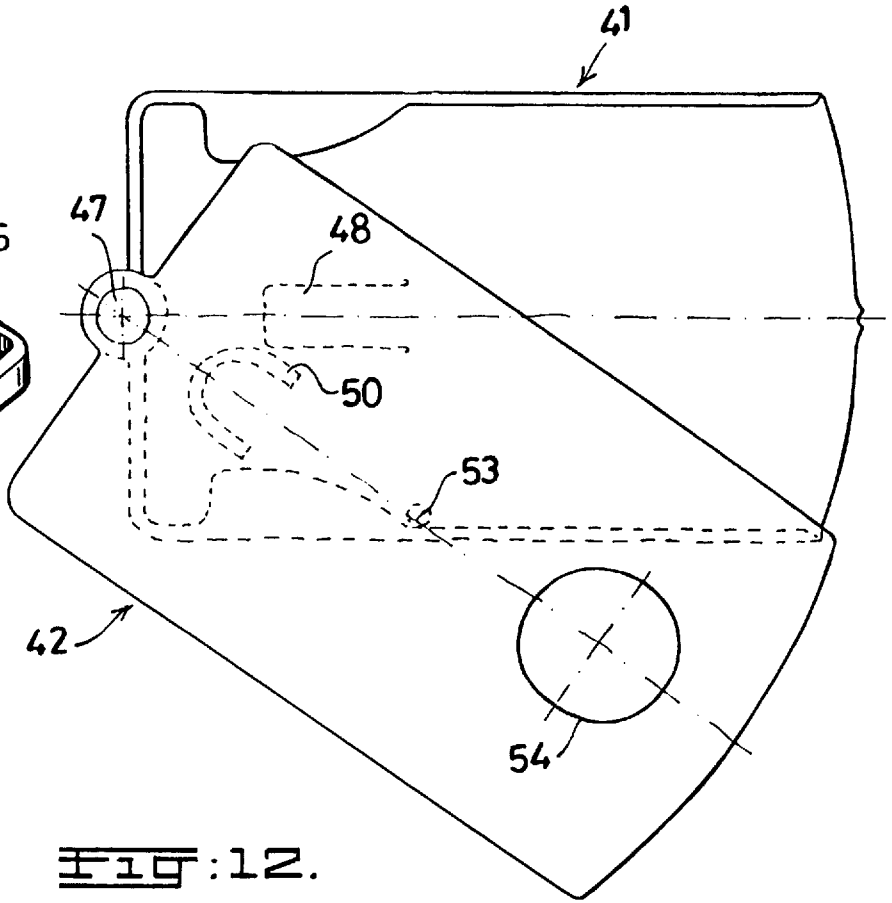
FIGS. 11 to 15 present a third embodiment, in the form of a swivelling box.
Figure 11:
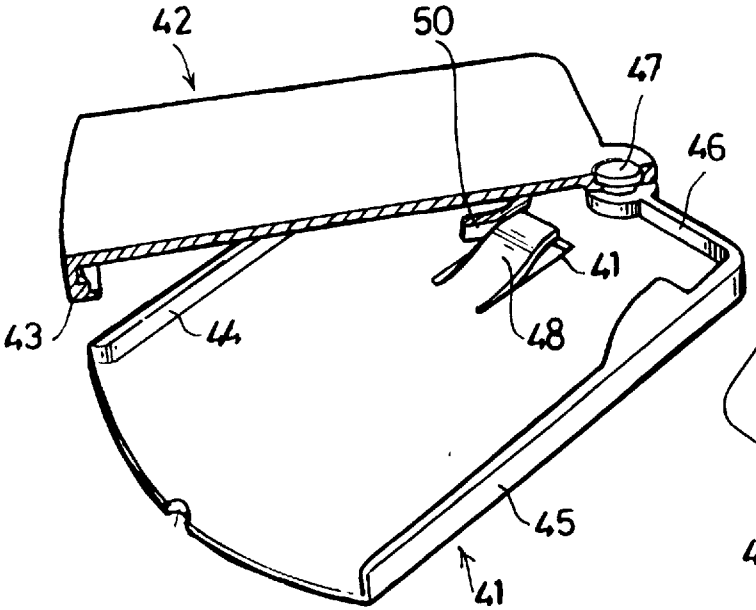
Figure 14A:
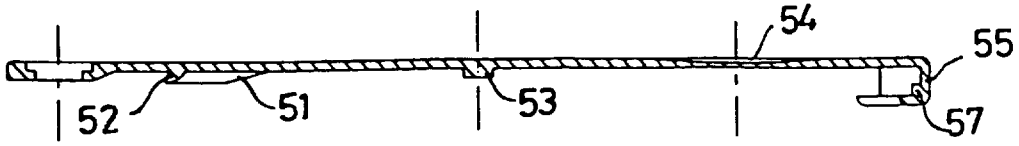
FIG. 14A is a corresponding longitudinal section along the centre line according to the arrows A—A in FIG. 14.
Figure 14:
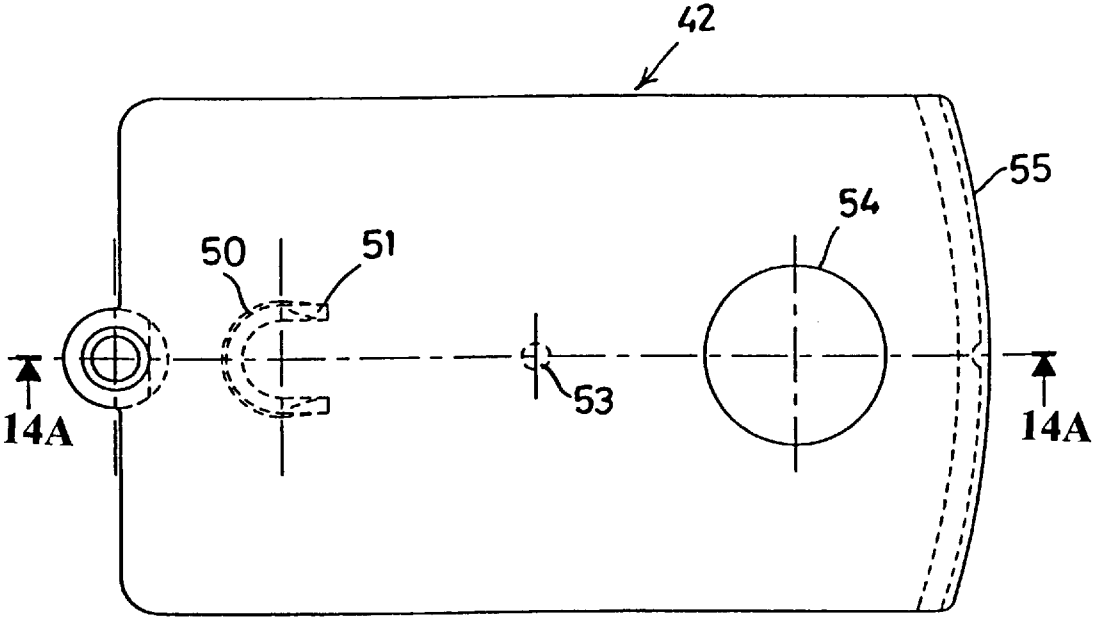

FIGS. 14 and 14A show further details of the lid part. The stop lug 50 is bevelled near both ends, as indicated at 51. The object of this bevel is to guide the lip, and thus to prevent the lid part from being able to shoot over the top of the stop lug 50 during blocking. Furthermore it is tooth-shaped in cross-section, as indicated at 52 in FIG. 14A, for correct interaction with the slanting end edge of the lip. A blocking pin 53 moulded onto the main face can also be seen. Said blocking pin serves to limit the maximum swivel movement of the lid part 42 relative to the box part 41, as shown in FIG. 12. A simple depression 54 serves for the placing of a thumb or finger during opening of the box. The end edge 55, which like the end edge 56 of the box part 41 is curved with a centre of curvature lying at the position of the axis of rotation 47 of the two parts, grips around said end edge 56 and below the bottom face 43 of the box part 41. In the course of this, a slight thickening 57 in the interior of the flanged edge 55 of the lid part can snap into a recess 58 (see FIG. 13) present in the longitudinal central face of the box part 41, in order to mark the closed rest position and prevent accidental opening, so that only when some force is exerted can the two parts swing open to the position shown in FIG. 12, in which the card can be removed.

Figure 15B:
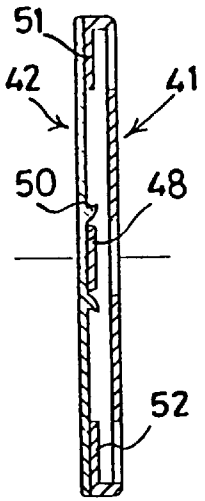
Figure 15:
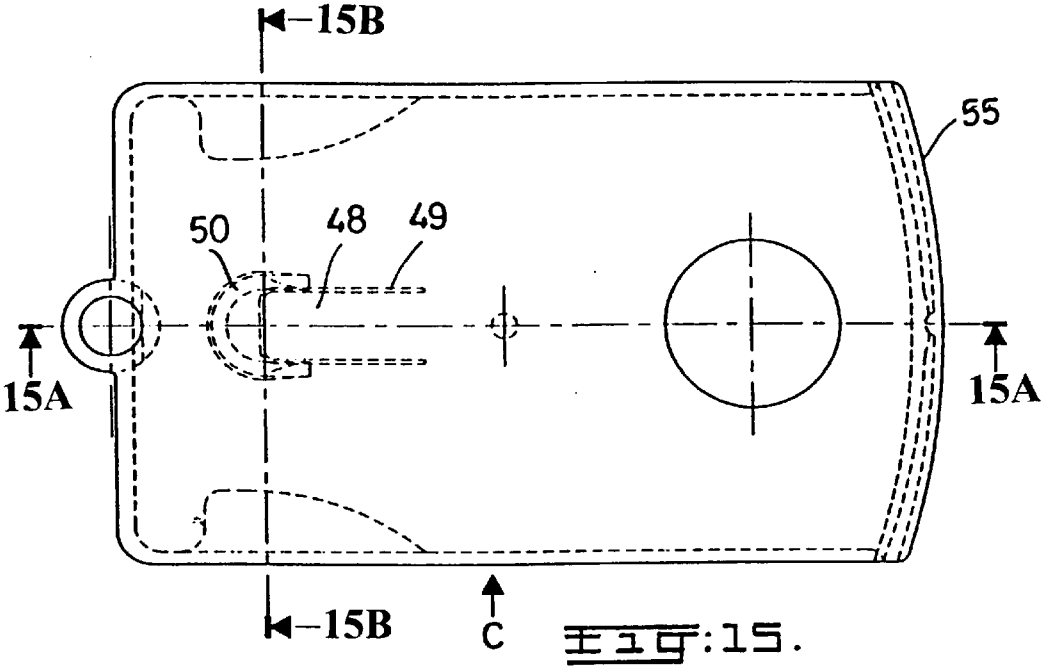
Figure 15C:
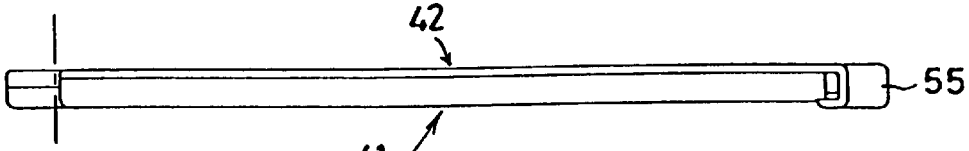
FIG. 15C is a side view according to the arrow C.
Figure 15A:
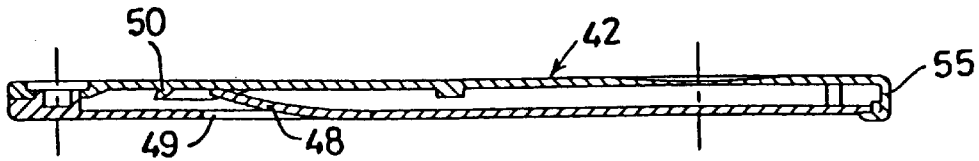
Figure 16:
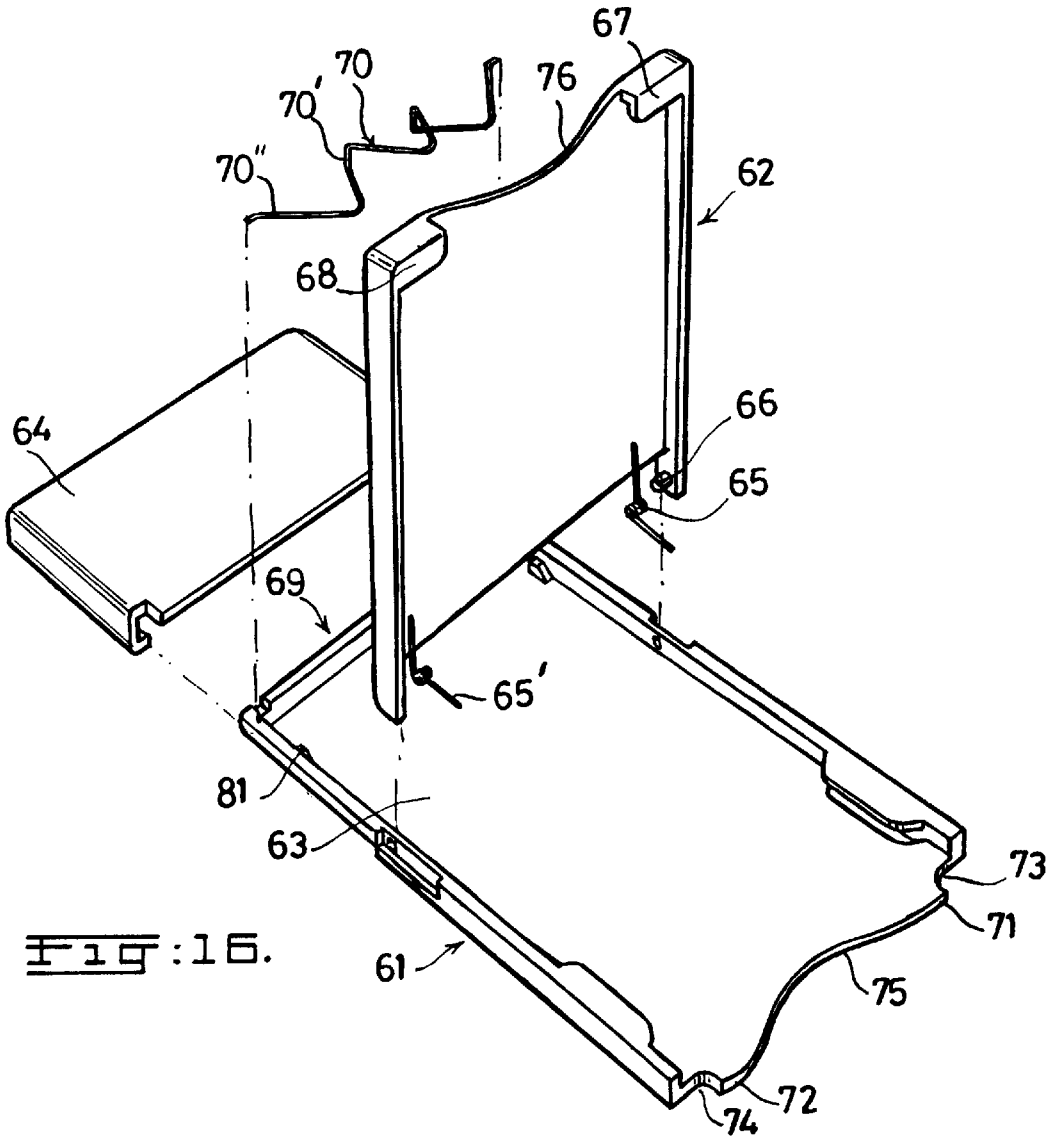

Finally, FIGS. 15 to 15C show the complete box in the closed position, but without card. It can be seen in particular from the sections of FIGS. 15A and 15C how the horseshoe-shaped stop lug 50 lies around the resilient lip 48, although this is only a theoretical position, for without a card the stop lug and resilient lip would keep the box closed, and it could never be opened again.

The fourth embodiment is illustrated in FIGS. 16 to 20; it is in the form of a folding box, It comprises a box part 61 and a lid part 62. The box part is composed of a bottom part 63 and a top part 64 which is intended for fitting immovably thereon. The part of the box remaining open thereafter is shut off by the lid part 62.

The lid part is pressed to the open position by two small springs 65 around the hinge pin 66. Gripping edges 67, 68 ensure that the lid 62 remains closed when a card is situated in the box.

For this purpose, a flat wire spring 70 is accommodated near the closed end 69 of the box part in the interior of the box. The internal length of the box corresponds to a card length plus the effective size of the spring 70 to be accommodated. Said internal length is then counted up to the points 71 and 72, where the fixed bottom part 63 has the greatest length. Outside the points 71, 72 the bottom face of the fixed bottom part 63 is provided with corner recesses 73, 74 respectively, of such shape that the two gripping edges 67 and 68 can go into them. Finger recesses 75, 76 are provided between the points 71 and 72 of the box part and between the gripping edges 67 and 68 of the lid part respectively.

When a card is placed in the box, with the end resting against spring 70, but not depressing the spring, the two corners of the card will project into the recesses 73 and 74. If an attempt is then made to close the lid, the gripping edges 67, 68 will go onto those corner zones again, so that they cannot reach the end position. This cannot happen until the card edge visible at the recesses 75 and 76 is pressed inwards slightly, against the action of the spring 70. The card corners consequently leave the region of the recesses 73 and 74, and the lid can be pressed further downwards. If the box is then kept shut while the card, on the other hand, is allowed to spring back under the influence of spring 70, the card corners will go into the inside of the gripping edges 67, 68. This keeps the lid shut.

The box is then opened by pressing the card inwards in the region of the recesses 75, 76, as a result of which the card corners are released from the gripping edges 67, 68, and the lid will spring open by itself under the influence of the lid springs such as 65.

The security principle is thus that the lid cannot be kept shut without the card being in the box. The open lid, which cannot be closed, is very conspicuous, so that it is in fact impossible to put away the box unnoticed in that state; it can be put away only after the temporarily removed card has been replaced therein.

The spring 70 has a central bend which at either side with parts 70' directed at right angles thereto merges into two lower down end pieces 70". This means that the spring is fixed in the vertical direction and always presses the card against the vertical parts 70'.

Figures 17, 17A, 17B, 17C, 17D:
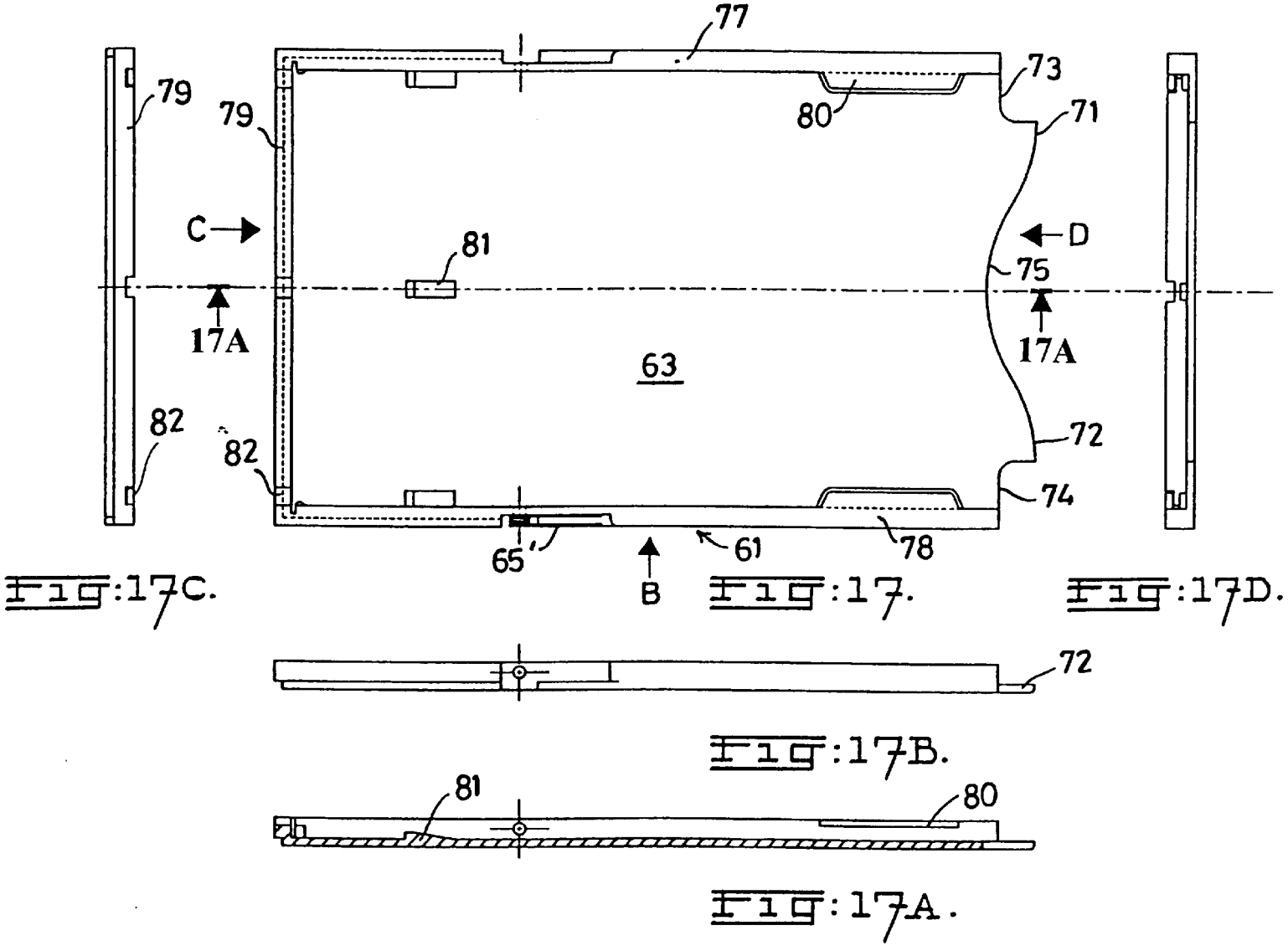

FIGS. 17 to 17D show further special features of the bottom part 63 of the box part 61. It is again provided with two raised edges 77 and 78 on the long sides and a raised end edge 79, by means of which the interior space is substantially determined for accommodation of the card. On the inside, the raised edges 77, 78 are both provided with a card guide such as 80 projecting into the interior. Said card guide is placed at the top, as can be seen from the section of FIG. 17A, so that the card can be inserted underneath it. However, the main function is to keep the card pressed down in the closed position of the box, for in that position the springs of the lid part which grips the card corners will have the tendency to pull the card upwards.

Situated on the bottom face 63 are three lugs such as 81 which, together with the lugs (yet to be described) on the fixed top part which ultimately lies on top of them, determine the vertical play of the card and ensure that the spring 70 (FIG. 16) to be placed behind it does not come out of the box. The raised end edge 79 is also provided with various recesses such as 82. These recesses are intended for the accommodation of projections on the fixed top part (yet to be described) which is glued thereon.

Figures 18, 18A, 18B, 18C, 18D, 18E:
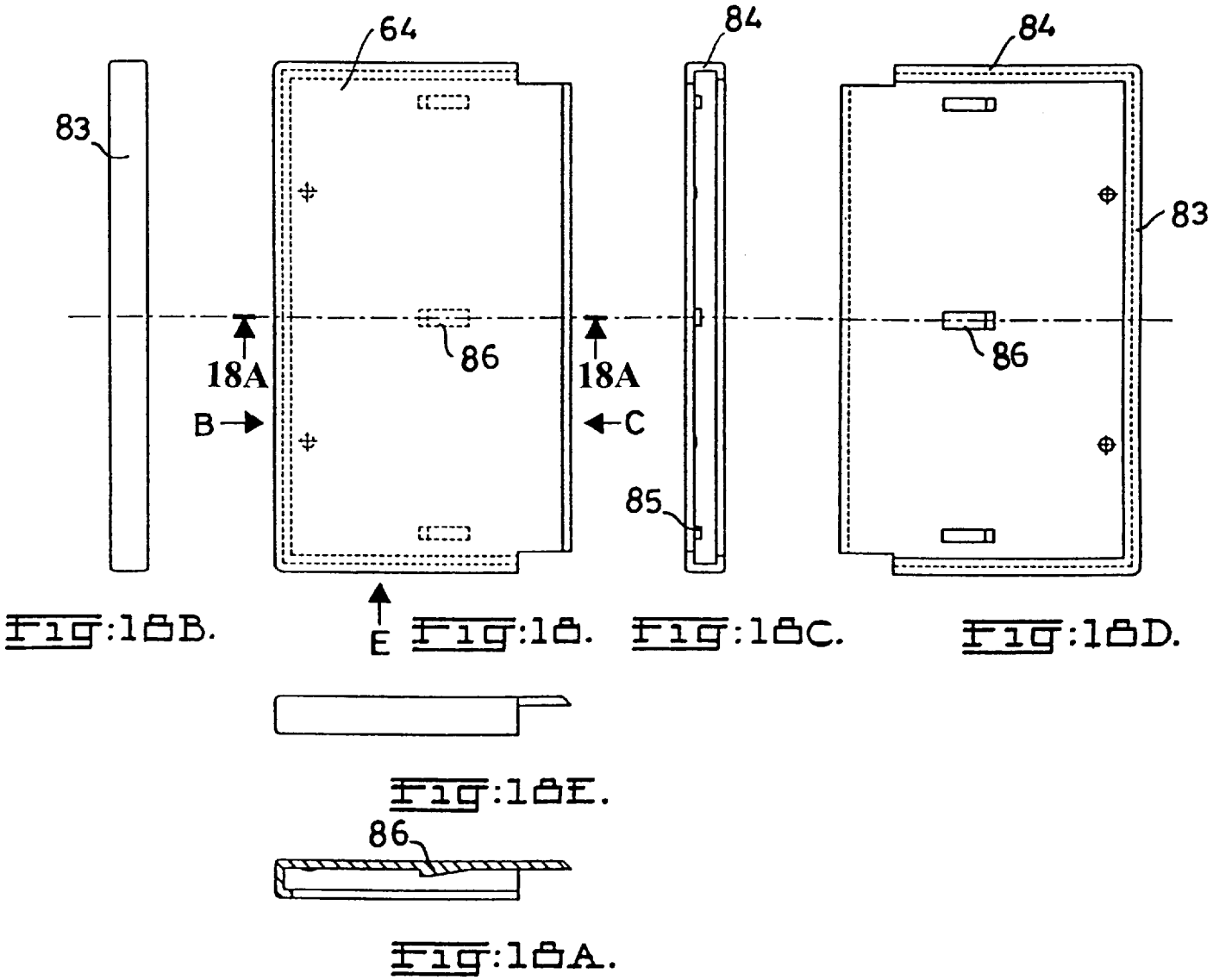

FIGS. 18 to 18E show the details of the fixed top part 64. The end edge 83 comes to rest against the raised end edge 69 of the bottom part 63 on the outside. Two doubly flanged edges such as 84 are provided on the short sides, which edges are intended to grip around the raised edges 77, 78 of the fixed bottom part 63 over a part of its length. For this purpose, the fixed top part 64 is slid from the end with said gripping edges around and over the bottom part 63 and glued. Slight elevations such as 85 in this case come to rest in the openings such as 62 (FIG. 17) in the fixed bottom part 63. Lugs such as 86 come to lie opposite lugs such as 81 (FIG. 17) on the fixed bottom part, for the purpose already mentioned: limiting the freedom of movement of the card and preventing the spring 70 from being lost.

Figures 19, 19A, 19B, 19C, 19D, 19E:
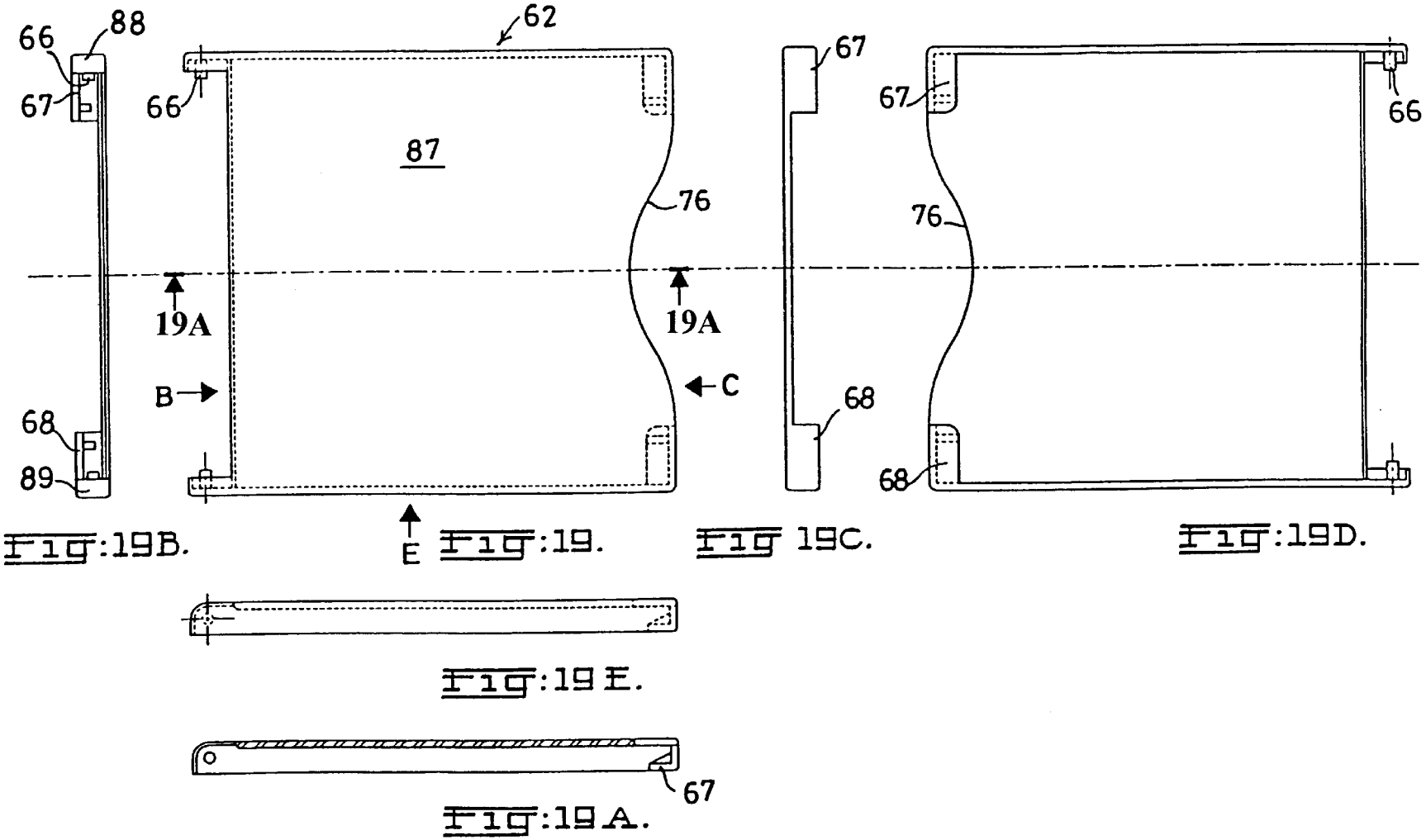

FIGS. 19 to 19E show the details of the movable top part or the lid 62. The main face 87 thereof is provided at two opposite sides with raised or—to put it better—overhanging edges 88, 89 (see FIG. 19B in particular), which are intended to come to rest outside the raised edges 77, 78 on the long sides of the fixed bottom part 63. In the same FIG. 19B the cross-section profile of the gripping edges 67, 68 can be seen in elevational view. The profile of said gripping edges in the lengthwise direction can be seen from the longitudinal section along the centre line shown in FIG. 19A. Owing to the slanting position, the card will slide upwards, with the result that the lid part, as a reaction, is pressed down and will close well.

Figures 20, 20A, 20B:
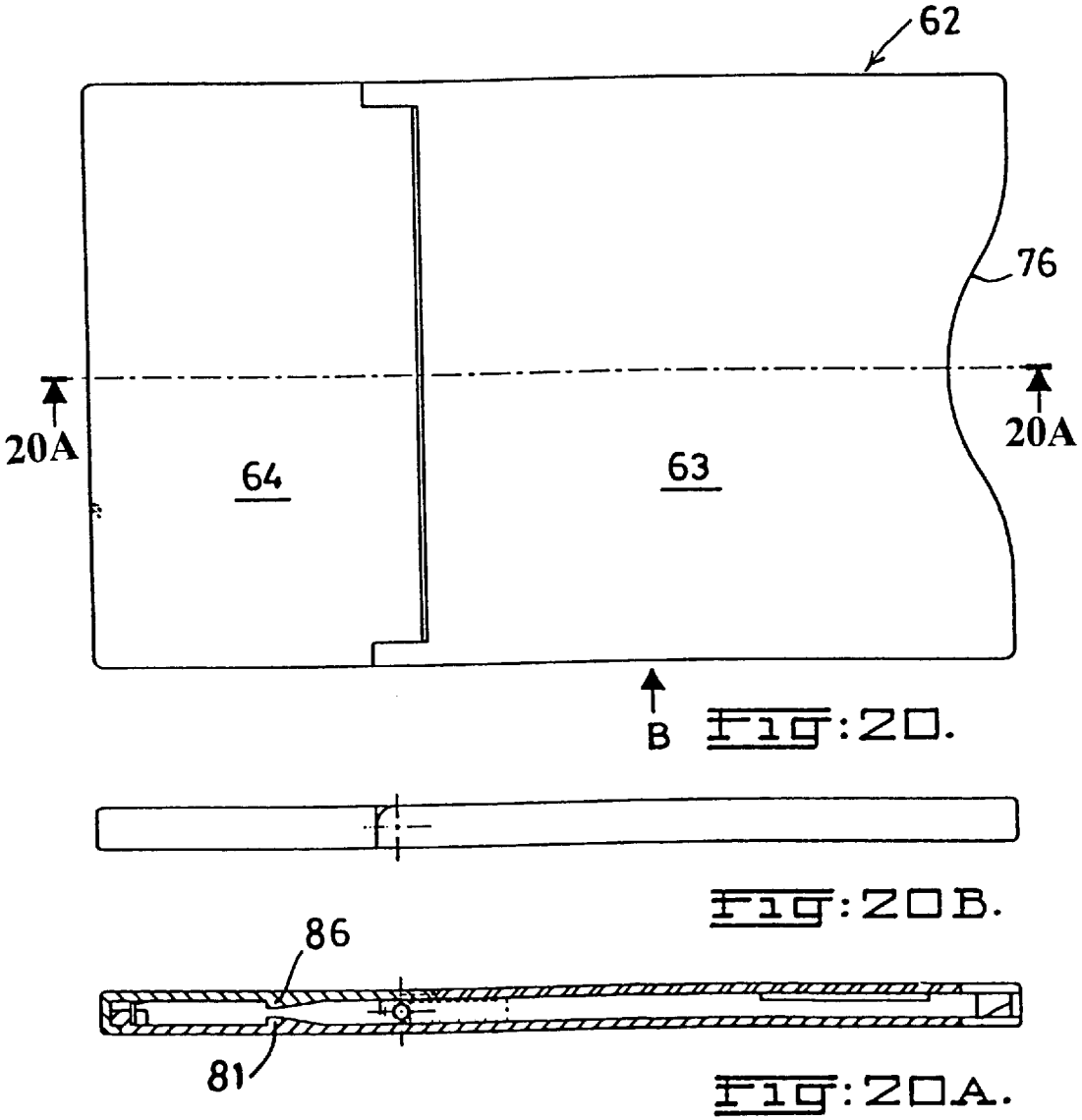

Finally, FIGS. 20 to 20B show the three parts of the box in the assembled state. The major part thereof will be clear, but attention is drawn to the two lugs 81 and 86. The movement-limiting function of these lugs will be clear from this figure, in order to ensure that the card lying therein comes to rest centrally in the vertical direction against the spring.

The embodiments of this invention including, in particular, the box-shaped embodiments of this invention may purposefully be integrated with a chip-card reader. Such readers, at least for indicating the remaining money value stored in the chip, but possibly also for indicating the most recent transactions performed with the chip-card, are known in themselves, for example as a key-ring.

What is claimed is:

1. A device for securing a card against being lost or mislaid, intended for use with a case or wallet having a compartment is which the card is to be kept, the device comprising:

two substantially flat parts which are hingedly connected to each other near an end edge of each, the hinged connection providing an axis of rotation of the parts between an open position and a closed position of the parts;

the first part near the hinged connection being provided with a chamber which is open near the end edge of the part, and a locking lever positioned within the chamber by a swivel pin, the locking lever being movable across the hinged connection to selectively block the movement of the parts to the closed position.

2. The device of claim 1, wherein the second part is provided with a first moulded-on finger at one side of said swivel pin, in such a position that when the two parts are moved about said hinged connection from the closed to the open position, the first moulded-on finger will push against the locking lever, causing the locking lever to swivel about said swivel pin, and a second moulded-on finger for receipt in the chamber when the parts are moved to the closed position, said second finger moulded in such a position that on said swiveling of the locking lever about said swivel pin, closing movement of the second part is blocked by the locking lever blocking receipt of said second finger in the chamber.

3. The device of claim 2, wherein the second part has an external and an internal face, and the material forming the hinged connection lies at least a predetermined thickness higher up than the internal face of the second part, thereby providing a slit-shaped space connected to said chamber, so that when said parts are in an open position, the slit-shaped space will allow a card to pass through said space into said chamber and to press against the locking lever and to swivel the locking lever back in order to release the blocking of the closing movement of the second part by the locking lever.

4. The device of claim 2, wherein said locking lever is provided with a resilient lip, against which said first finger comes to rest during opening, which lip by resilient action during closing allows said first finger to pass said lip.

* * * * *